United States Patent [19]

Cherrington

[11] Patent Number: 4,618,008

[45] Date of Patent: Oct. 21, 1986

[54] VERTICAL DRILLING METHOD AND APPARATUS

[76] Inventor: Martin D. Cherrington, 8600 Emperor Dr., Fair Oaks, Calif. 95628

[21] Appl. No.: 642,864

[22] Filed: Aug. 21, 1984

[51] Int. Cl.[4] ..... E21B 21/00; E21B 4/00

[52] U.S. Cl. ..... 175/65; 175/94

[58] Field of Search ..... 175/65, 85, 86, 93, 175/94, 122, 325; 299/19

[56] References Cited

U.S. PATENT DOCUMENTS

| | | | |
|---|---|---|---|
| 2,976,027 | 3/1961 | Allimann | 175/94 X |
| 3,085,794 | 4/1963 | Johansson et al. | 175/86 X |
| 3,399,738 | 9/1968 | Haspert | 175/94 X |
| 3,604,754 | 9/1971 | Kampf-Emden et al. | 175/94 X |
| 3,830,318 | 8/1974 | Busby et al. | 175/122 |
| 4,009,909 | 3/1977 | Robbins et al. | 175/94 X |
| 4,114,698 | 9/1978 | Webb et al. | 175/52 X |
| 4,179,001 | 12/1979 | Still et al. | 175/94 X |
| 4,248,312 | 2/1981 | Jinno et al. | 175/94 X |

FOREIGN PATENT DOCUMENTS 186342 7/1907 Fed. Rep. of Germany ..... 175/122

*Primary Examiner*—Stuart S. Levy
*Assistant Examiner*—Thomas R. Hannon
*Attorney, Agent, or Firm*—Townsend and Townsend

[57] ABSTRACT

A method and apparatus for drilling a vertical hole from an underground chamber to the surface includes the emplacement of a preassembled, vertical drill string including a drill bit mounted in a cylinder installed below the underground chamber. When vertical drilling is required, piston lifts the drill string and extends it from the cylinder into the overlying rock. Circulating fluid drives the drill bit and removes the rock debris from the resulting, vertically progressing hole. Drilling continues until the surface is penetrated, and the drill string is retracted into the cylinder, enabling access to the surface through the resulting hole.

19 Claims, 15 Drawing Figures

VERTICAL DRILLING METHOD AND APPARATUS

FIELD OF THE INVENTION

This invention relates generally to drilling and tunneling methods, and specifically to a technique for drilling upwardly from an underground chamber to effect communication with the earth's surface.

BACKGROUND OF THE INVENTION

In the event of a military strike against this country, it can be expected that our offensive and defensive missile systems would be prime targets for enemy attack. Thus, the sheltering of these systems from the effects of such an attack is accordingly of great concern.

Among other alternatives, it is contemplated that our missile systems should be built inside large underground caverns at extreme depths below the surface, beyond the destructive effects of an enemy warhead. For example, it is anticipated that in a major strike on a missile installation, the first one thousand feet or so of surface soil and rock would be turned into rubble. Accordingly, it is suggested that the caverns be constructed at depths on the order of 3,000 feet below the surface. After the attack, tunnels could be burrowed upwardly through the earth and rubble, effecting communication with the surface and enabling the launch of a possible counterattack by our missiles.

Numerous kinds of drilling systems have been developed to accomplish a variety of drilling and tunneling objectives. For example, conventional oil well drilling rigs utilize a rock crushing bit mounted on the end of a drilling string made up of sections of pipe. A rotating "table" mounted on the rig platform slidably engages the drill string, and provides the rotational motion necessary for the bit to fracture the rock that it encounters. Drilling fluid is pumped through the drill string and out of the bit, where the fluid acts to clean the bit and carry the crushed rock back up to the surface through the hole that has been drilled. The sliding engagement of the rotating table with the drill string enables the entire string to extend downwardly under the influence of gravity as the bit progressively "makes hole". Additional sections of pipe can be added to the string as needed, to achieve the desired hole depth.

An alternative drilling method utilizes a fluid driven drill bit, e.g. a positive displacement motor. In this arrangement, the circulation of the fluid pumped down the drill string causes a specially designed bit to rotate, and thus no rotating table is needed to turn the entire drill string.

Both of these methods provide bit rotation, but rely on gravitational force to achieve their downward drill string travel. While both methods have been successfully used in slant drilling applications, and have achieved downwardly drilled holes at angles of 45° from the vertical and greater, they are not structurally suited for vertically upward drilling. Thus, neither method would be usable in the contemplated system requiring vertical penetration.

Machines for boring or tunneling upwardly are well known in the art, and are often referred to as raise-boring or box hole machines. Representative of many of the mechanisms used is the system disclosed in Webb U.S. Pat. No. 4,114,698, which provides an improved system for connecting new sections of pipe to a drill stem, while maintaining the vertical position of the drill string and cutting head. Another prior art patent, Still U.S. Pat. No. 4,179,001, shows a mechanism for installing a liner or casing in a vertical shaft concurrently with the drilling of the shaft. Jinno, et al., U.S. Pat. No. 4,248,312, discloses a full-face boring system with simultaneous installation of a side wall shield.

While these prior art systems to indeed provide a means for the drilling of a vertical hole, they all require a piecemeal assembly of the segmented drill stem to extend their length in an upward direction. Such assembly is laborious and time-consuming, and requires large areas within the underground chamber for the storage of the equipment and drill pipe needed. Drilling time is further increased by the fact that drill head servicing requires complete, piecemeal breakdown of the drill string for retrieval of the bit, followed by reassembly of the string in the original manner.

SUMMARY OF THE INVENTION

The vertical drilling method and apparatus of this invention solves these problems by the emplacement of a vertical drilling system into the subterranean chamber before any subsequent vertical drilling is required. Emplacement of the system is accomplished in the following manner. First, a hole is drilled from the earth's surface into the underground chamber, separately provided. The hole penetrates the chamber and is additionally drilled beyond and below the chamber a distance generally equal to the depth of the chamber itself; thus, the total depth of the hole is generally twice the depth of the chamber.

The portion of the hole below the chamber is provided with a piston or lift system, including pipes or conduits to deliver lifting fluid to the bottom of the hole and into the piston cylinder.

A drill string generally of a length equal to the length of the lower hole portion plus the height of the subterranean chamber is assembled at the surface and introduced into the cylinder created in the lower hole, where it is then left in place. This drill string is preferably equipped at its uppermost end with a vertically oriented fluid driven drill bit, such as a positive displacement motor, and is sealed off at both the chamber floor and chamber ceiling with a packing head. The portion of the original hole above the drill bit is then filled in and/or cemented, thereby sealing off the drill string and chamber from the surface.

The chamber is equipped with a dual system of pumps. One system delivers fluid under pressure to the aforementioned piston or lift system, whereby the entire drill string can be forced upwards. The other pump system delivers a flow of fluid through the lower packing head to the drill string itself, where the fluid is diverted upwards and towards the drill bit, where it provides the motive force for bit cutting. An accompanying system of pipes, screens, sump pits and the like provide the requisite cleaning system for these fluids.

Once in place, the vertical drilling system of this invention can be operated. Energization of the lift system pump initiates fluid flow to the cylinder and causes the piston system to exert a lift to the drill string. Energization of the fluid driven drill system pump initiates a separate fluid flow through the drill string and causes the drill bit to cut, as by rotation. Thus, the drill string moves upwards out of the piston cylinder and towards the earth's surface. Once the surface is penetrated, the drill string can be retracted, the packing heads removed from the chamber ceiling and floor, and the portion of the drill string above the chamber floor disassembled. The resulting bored through the earth and rubble can be used for communication with the surface for messages, alignment and even launching of counterattack missiles from the chamber.

BRIEF DESCRIPTION OF THE DRAWINGS

FIG. 2A is a diagram illustrating the placement of a drilling rig on the surface above an underground chamber;

FIG. 2B is a diagram of the downward drilling of a hole through and below the chamber to total depth;

FIG. 2C is a diagram of the withdrawal of the main drill string;

FIG. 2D is a diagram of the placement of the equipment in the chamber portion of the vertical drilling apparatus;

FIG. 2E is a diagram of the placement of the equipment in the lower portion of the vertical drilling apparatus; and FIG. 2F is a diagram of the placement of the equipment in the upper portion of the vertical drilling apparatus, the final cementing of the hole and removal of the drilling rig;

FIG. 6A is a view of the vertical drilling apparatus beginning to drill upwardly;

FIG. 6B is a view of the vertical drilling apparatus having penetrated the earth's surface;

FIG. 6C is a view of the vertical drilling apparatus being retracted to its original position; and FIG. 6D is a view of the equipment being removed from the upper portion and chamber portion of the vertical drilling apparatus.

DETAILED DESCRIPTION OF A PREFERRED EMBODIMENT

Figure 1:
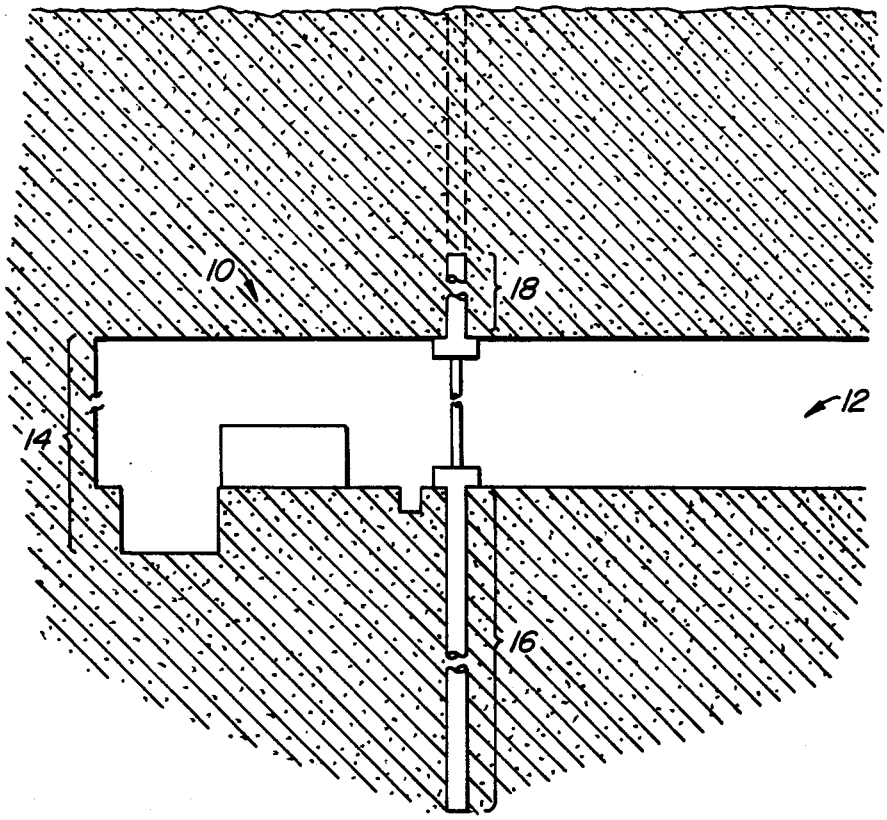
FIG. 1 is a diagram of a vertical drilling apparatus of this invention.

FIG. 1 is a diagram of a vertical drilling apparatus 10 of this invention as placed in an underground chamber 12. The construction of the underground chamber is not discussed or within the scope of this application, rather, it is contemplated that such an underground chamber is separately provided. The chamber 12 may be placed at any depth below the surface, but typically is on the order of 3,000 feet deep. The chamber may be of any size and extent, but is typically on the order of 20 feet in diameter, and may communicate with other chambers of various sizes and orientations.

The drilling apparatus 10 broadly includes a chamber portion 14, which comprises the mechanical systems necessary to drive the apparatus, a lower portion 16, which comprises the lift system, and an upper portion 18, which comprises the drilling system. The installation of these systems will be generally discussed with reference to FIGS. 2A through 2F. The component parts of each system will then be separately discussed with reference to FIG. 3 (chamber portion 14), FIG. 4 (lower portion 16) and FIG. 5 (upper portion 18). Finally, operation of the apparatus will be discussed with reference to FIGS. 6A through 6D.

Figure 2A:
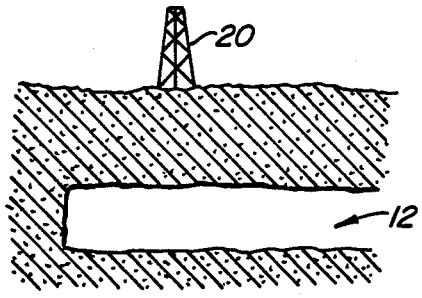
FIGS. 2A through 2F are a series of diagrams illustrating the installation of a vertical drilling apparatus.
Figure 2B:
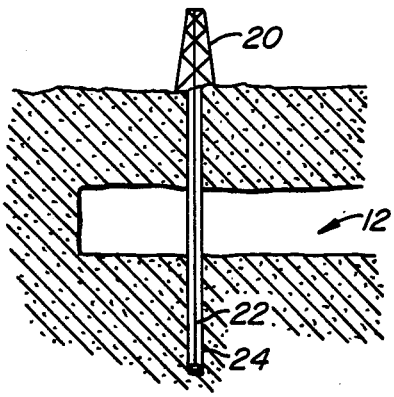
Figure 2C:
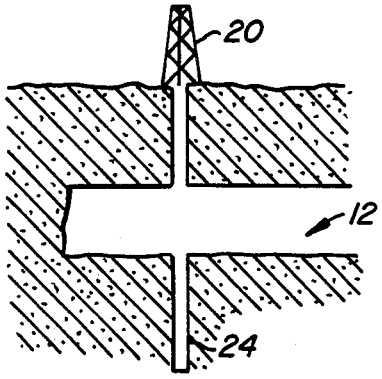

FIGS. 2A through 2F illustrate the installation of the vertical drilling apparatus. First, a conventional drilling rig 20 is erected on the surface over the underground chamber 12. The rig 20, using conventional and well known earth drilling methods, uses a drill string 22 to drill a hole 24 down to and through the chamber 12. The hole 24 is drilled to a total depth of approximately twice the depth of the chamber 12. In the preferred embodiment, the chamber 12 is located 3,000 feet below the surface, and the hole 24 is drilled to approximately 6,000 feet plus. After drilling to this depth, the drill string 22 is retracted back to the surface (FIG. 2C).

The reader can understand drilling can occur underground if required.

Figure 2D:
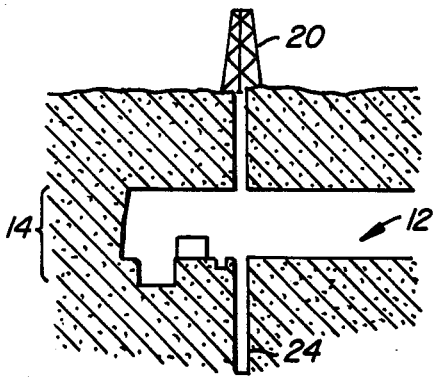
Figure 2E:
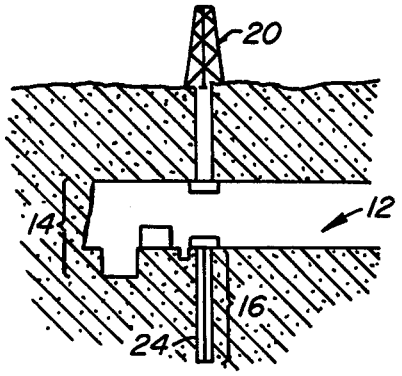
Figure 2F:
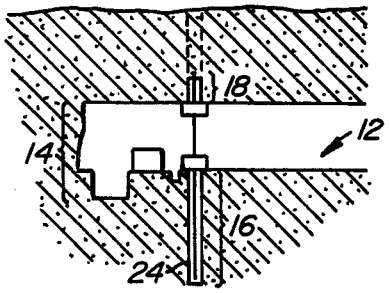

FIG. 2D illustrates the installation of the equipment of the chamber portion 14, which is accomplished from within the chamber itself. FIG. 2E illustrates the installation of the equipment of the lower portion 16, which is accomplished with the assistance of the drill string 22. FIG. 2F illustrates the equipment installed in upper portion 18, and the filling or cementing of that part of the hole 24 above the upper portion 18. This work is performed by the rig 20 and, when completed, the rig can be moved off location.

Figure 3:
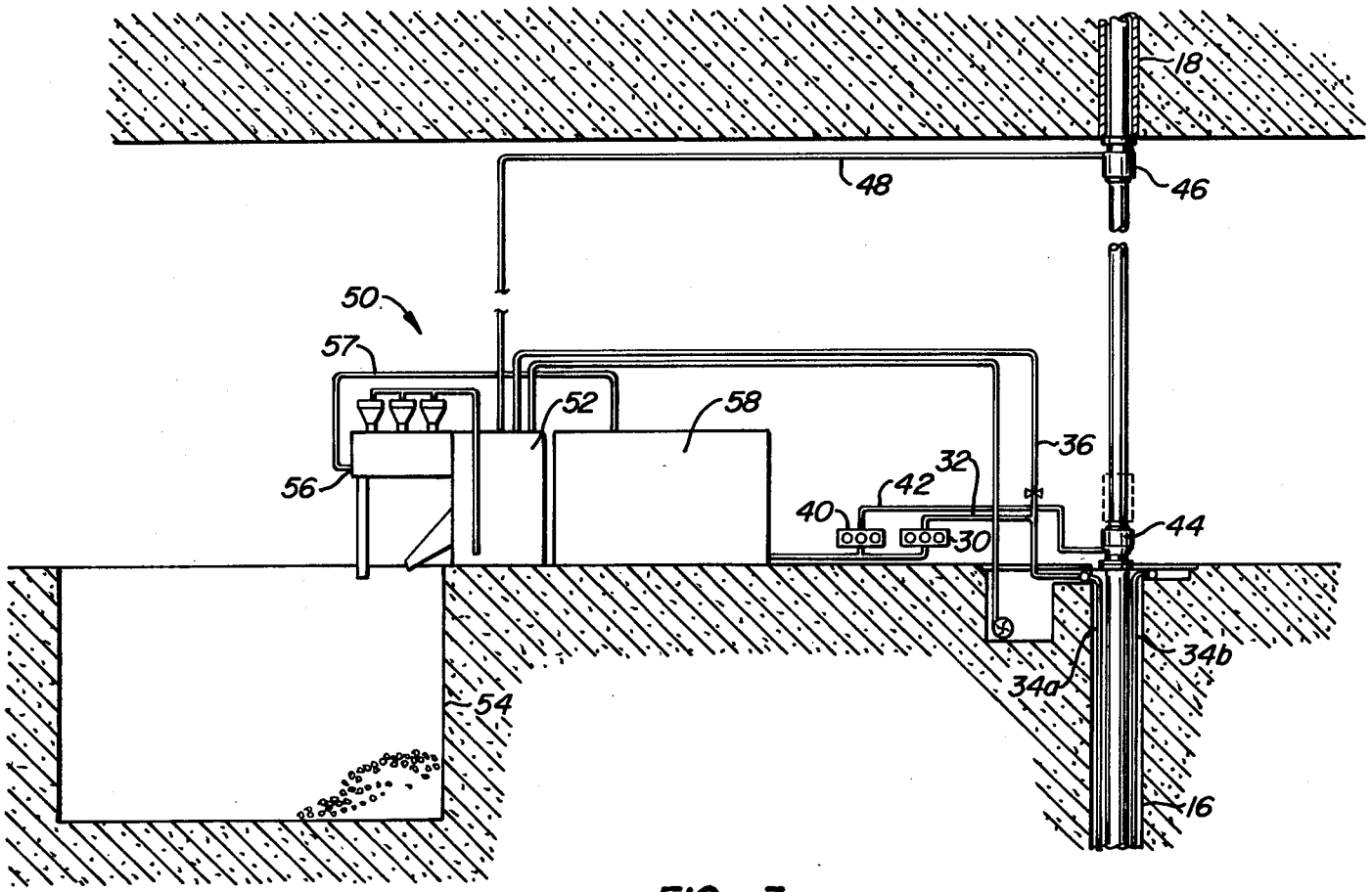
FIG. 3 is an elevated side view of the chamber portion of the vertical drilling apparatus.

FIG. 3 illustrates a side view of the components of the chamber portion 14. These components are all well known in the well drilling industry, although not necessarily in the particular arrangement disclosed. Accordingly, the components themselves will not be described in great detail, but rather their function to achieve the required vertical drilling ability will be emphasized.

Two major mechanical systems are involved in this apparatus. First, a drill pipe lifting system acts to lift or extend the vertical drill string and comprises a lift pump 30 which pumps a fluid through a pipe 32 to a set of lift fluid down pipes 34*a, b,* where the fluid is delivered to the lower portion 16. This lift fluid does not circulate, but rather, when the vertical drill string is being retracted, the fluid is returned to the chamber via the pipes 34*a, b* to a lift fluid return pipe 36. The action of this fluid will be discussed in greater detail in the description of the lower portion 16, supra.

A drill bit powering system acts to provide the fluid necessary to power the hydraulic drill bit and comprises a drilling pump 40 which pumps a fluid through a pipe 42 to a lower packing head 44, located on the chamber floor above the lower portion 16. From the lower packing head 44, the drilling fluid is delivered through the lower portion 16 up to the upper portion 18, where it serves to drive, for example, a hydraulic drill bit. The action and circulation of this fluid will be discussed in greater detail in the description of the lower portion 16 and the upper portion 18.

This drill fluid is returned to the chamber through an upper packing head 46, which is located on the chamber ceiling directly below the upper portion 18. From the upper packing head 46 the fluid is delivered via a pipe 48 to a solids control system 50.

The solids control system 50 includes a first stage coarse cleaning unit 52, which serves to screen the used fluid and dump the waste solids into a spoil pit 54. This first stage cleaned fluid is delivered to a centrifugal cleaning unit 56 for centrifugal separation of the remaining solids. The waste solids from this step are also dumped into the spoil pit 54. The cleaned fluid is delivered via a pipe 57 to a fluid mixing unit 58, which acts as a fluid mixing area as well as a reservoir for the fluids required by the lift pump 30 and the drilling pump 40 to perform their respective operations.

Figure 4A:
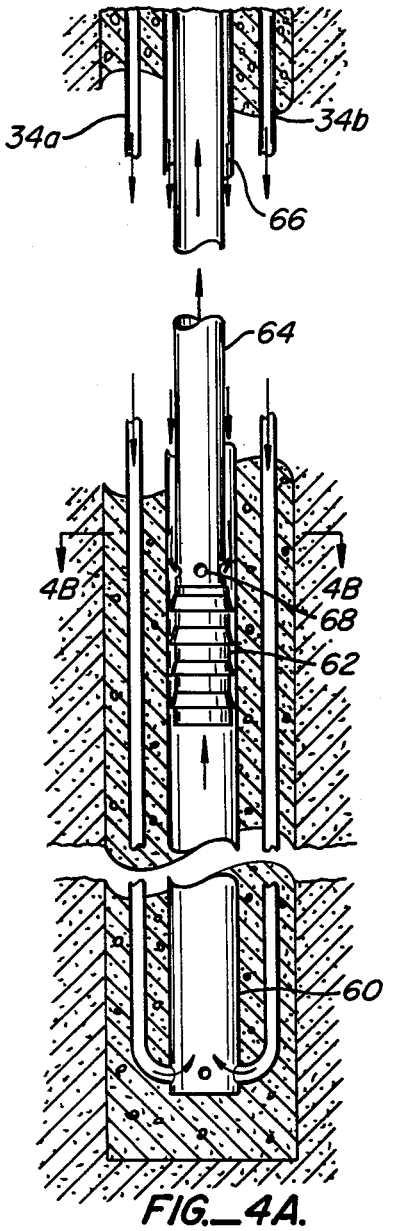
FIG. 4A is an elevated side view of the lower portion of the vertical drilling apparatus.
Figure 4B:
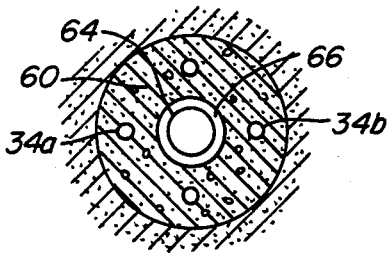
FIG. 4B is a cross-sectional view taken along line A—A of FIG. 4A.

FIGS. 4A and 4B illustrate the lower portion 16 of the vertical drilling apparatus. The lift fluid down pipes 34*a, b* deliver lift fluid down the lower portion 16 to its base, where the lift fluid is introduced to a piston cylinder 60, thereby exerting pressure on and raising a lift piston 62 vertically within the cylinder 60. The lift piston 62 supports a vertical drill string 64, and thus drives this drill string vertically upward in response to pressurization of the lift fluid within the cylinder 60.

Drill fluid delivered from the drilling pump 40 via the pipe 42 and the lower packing head 44 is delivered down the lower portion 16 in an annular space 66 located between the drill pipe 64 and the cylinder 60. The drill fluid enters the center of the drill pipe through a series of apertures 68, where it is then delivered up the drill string towards the upper portion 18.

Figure 5:
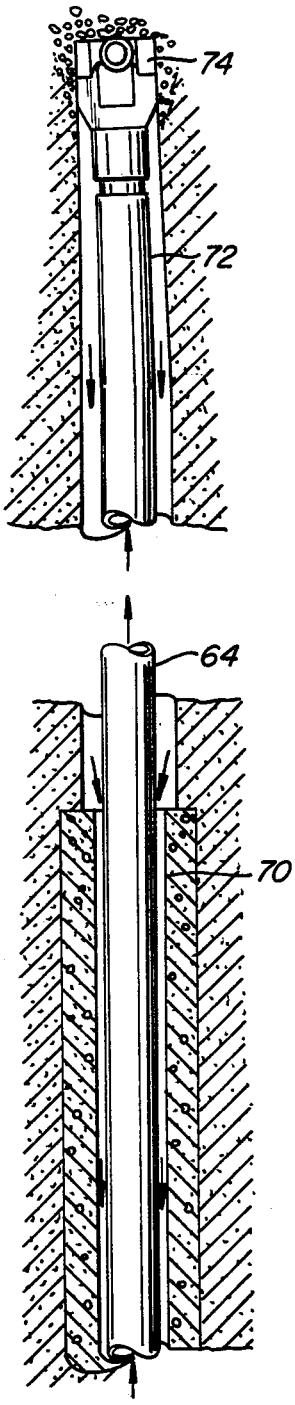
FIG. 5 is an elevated side view of the upper portion of the vertical drilling apparatus.

FIG. 5 illustrates the components of the upper portion 18. Drilling fluid is delivered up the center of the drill pipe 64 past the level of a steel casing 70 to a fluid driven drill 72 including a rock cutting bit 74. The moving drill fluid causes the drill 72 to power the bit 74, thereby crushing the rocks in front of the bit and enabling the drill string 64 to move upwards under the influence of the piston 62. The drill fluid is exhausted through the bit 74, thereby cooling and lubricating the bit, and serves to flow the rock debris away from the bit and back down the hole. The fluid returns down the hole in the annular region between the drill string 64 and the sides of the hole and, further down, between the drill string and the steel casing 70. The fluid thus returns to the solid control system via the upper packing head 46 and the pipe 48 in the chamber portion.

Figure 6A:
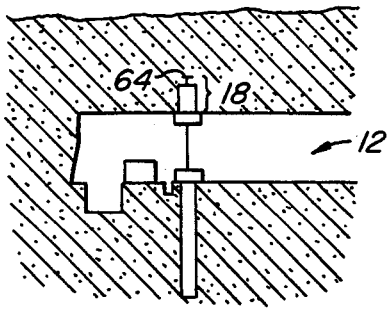
FIGS. 6A through 6D are a series of views showing the operation of the vertical drilling apparatus.
Figure 6B:
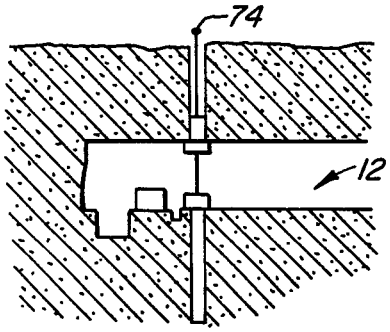
Figure 6C:
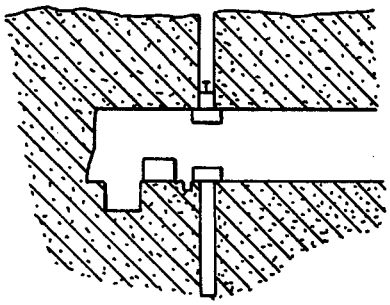
Figure 6D:
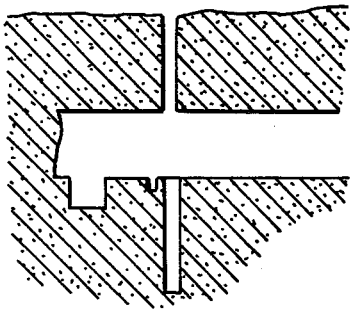

FIGS. 6A through 6D show the sequence of vertical drilling. In FIG. 6A, the vertical drill string 64 has just begun to be extended upwards from the upper portion 18. Drill bit servicing and/or replacement is accomplished by retraction of the drill string back into the cylinder, dismantling of the upper packing head, and retrieval of the upper portion of the drill string, including the bit. Reversal of this sequence enables continued drilling. FIG. 6B illustrates the drill string 64 fully extended, with the drill bit 74 having penetrated the surface. FIG. 6C shows the drill string retracted back to its original, predrilling position, with the hole remaining open above it. FIG. 6D illustrates the chamber with the equipment and material from the upper portion 18 and the chamber portion 14 having been dismantled and removed to another part of the chamber, thereby enabling the new hole to be used as an access for the communication with the surface for messages and even launching of missiles from within the cavern.

While this invention has been described in connection with preferred embodiments thereof, it is obvious that modifications and changes therein may be made by those skilled in the art to which it pertains without departing from the spirit and scope of the invention. For example, the vertical hole drilled need not be precisely vertical, but could, using well known directional drilling techniques, be slanted in any number of directions. In this way, several holes slanted from one another could be drilled from the same apparatus. Furthermore, instead of employing a piston arrangement to lift the drill string upwards, a mechanical system such as a driven gear could be utilized to lift the string, and still would not require the piecemeal assembly of the vertical drilling string. As a further alternative, the entire apparatus could be installed from within the chamber itself, without the necessity of a surface-mounted drilling rig to provide the upper portion of the hole. This would, of course, require the drilling and assembly of the lower portion of the hole from within the chamber, but would still result in a unitary vertical drilling apparatus superior to existing types. Similarly, fluid, either gas or liquid, can be used for drilling, either by bit or jet. It will be understood the words "bit" and "jet" are used interchangeably in the specification and claims. Accordingly, the scope of this invention is to be limited only by the appended claims.

What is claimed as invention is:

1. A method for drilling a vertical hole from an underground chamber to the earth's surface comprising the steps of:

providing an underground chamber at a depth below the earth's surface;

providing an original hole from the surface to said chamber, through said chamber and below said chamber a distance at least equal to the depth of said chamber;

providing said original hole with a drill string to occupy the portion of the original hole below said chamber;

providing a rock cutting bit on the uppermost end of said drill string;

providing a means to lift said drill string from the portion of the original hole below said chamber to the portion of the original hole above said chamber;

providing a means to power said rock cutting bit; and lifting said drill string and powering said rock cutting bit from the portion of said hole below said chamber to the portion of said hole above said chamber whereby said drill string drills along the path of said original hole above said chamber.

2. The vertical drilling method of claim 1 wherein the length of said drill string is greater than the depth of said underground chamber.

3. The vertical drilling method of claim 1 wherein said new hole is drilled along a path offset from said original hole.

4. The vertical drilling method of claim 1 wherein said original hole is refilled after drilling from a point above said bit to said surface.

5. The vertical drilling method of claim 1 wherein said original hole is cemented above said drill bit.

6. The vertical drilling method of claim 1 wherein said lifting means comprises a piston actuated by a pressurized fluid.

7. The vertical drilling method of claim 6 wherein said pressurized fluid is provided by a lifting pump.

8. The vertical drilling method of claim 6 including a means for cleaning said pressurized fluid.

9. The vertical drilling method of claim 1 wherein said powering means comprises a fluid driven bit actuated by a circulated fluid.

10. The vertical drilling method of claim 9 wherein said circulated fluid is provided by a pump.

11. The vertical drilling method of claim 9 including a means for cleaning said circulated fluid.

12. The vertical drilling method of claim 1 wherein said lifting means and said powering means are each fluid actuated, and further including a common means for cleaning and storing said fluid.

13. A method for drilling a vertical hole from an underground chamber to the earth's surface comprising the steps of:

providing an underground chamber;

drilling a hole from the surface to said chamber, passing through said chamber, and extending below said chamber a distance at least equal to the depth of said chamber;

inserting into the portion of said hole extending below said chamber with a drill string;

providing a rock cutting bit on the uppermost end of said drill string;

providing a means to lift said drill string;

providing a means to power said rock cutting bit whereby said drill string can be lifted and powered to enable said rock cutting bit to drill a new hole.

14. An apparatus for drilling a vertical hole comprising:

an underground chamber;

a vertical hole defined in the ground immediately above said chamber, through said chamber, and below said chamber a distance at least equal to the depth of said chamber;

a drill string mounted in said vertical hole below said chamber;

a rock cutting bit disposed on the upper end of said drill string for confrontation to the portion of said hole above said chamber;

means for powering said rock cutting bit within said chamber; and, means for raising said drill string while said means for powering said rock cutting bit powers said rock cutting bit to enable a hole to be drilled from the chamber to the surface.

15. The vertical drilling apparatus of claim 14 wherein the length of said drill string is greater than the depth of said underground chamber.

16. The vertical drilling apparatus of claim 14 wherein said lifting means comprises a piston actuated by a pressurized fluid.

17. The vertical drilling apparatus of claim 16 wherein said pressurized fluid is provided by a lifting pump.

18. The vertical drilling apparatus of claim 16 wherein said powering means comprises a fluid driven bit actuated by a circulated fluid.

19. The vertical drilling apparatus of claim 18 wherein said circulated fluid is provided by a pump.

* * * * *